United States Patent [19]

Fornell

[11] Patent Number: 5,050,363

[45] Date of Patent: Sep. 24, 1991

[54] BULLET RESISTANT FRAME STRUCTURE

[76] Inventor: James P. Fornell, 25257 W. Eight Mile Rd.,, Detroit, Mich. 48240

[21] Appl. No.: 566,131

[22] Filed: Aug. 13, 1990

[51] Int. Cl.[5] ..... E06B 3/10; E06B 5/10; E05G 1/026

[52] U.S. Cl. ..... 52/656; 109/58; 52/731

[58] Field of Search ..... 52/656, 731; 109/58

[56] References Cited

U.S. PATENT DOCUMENTS

| | | | |
|---|---|---|---|
| 3,152,672 | 10/1964 | Oppenhuizen et al. | 52/731 X |
| 3,305,221 | 2/1967 | Kling | 52/731 X |
| 4,580,380 | 4/1986 | Ballard | 52/731 X |
| 4,624,091 | 11/1986 | Biro | 52/656 |
| 4,640,078 | 2/1987 | Haffer | 52/731 |
| 4,977,722 | 12/1990 | Taylor | 52/656 |

FOREIGN PATENT DOCUMENTS

| | | | |
|---|---|---|---|
| 2602264 | 2/1988 | France | 109/58 |

*Primary Examiner*—Scherbel, David A.
*Assistant Examiner*—Deborah M. Ripley
*Attorney, Agent, or Firm*—Charles W. Chandler

[57] ABSTRACT

An architectural rail system usable in doors, windows, and building walls for supporting and framing panels. Hollow aluminum rails are formed with internal ribs that form tracks for the slidable reception of ballistic steel strips or panels. The rails are thus structurally and ballistically reinforced against penetration by small caliber projectiles fired from rifles and/or pistols. The rail panel-framing system is useful where security against armed attack is a consideration, e.g. in banks, cashier stations at movie theatres, area ticket windows, fast food restaurants, etc.

18 Claims, 1 Drawing Sheet

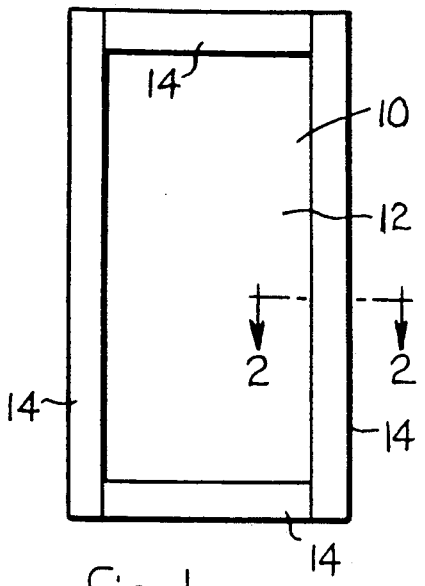
Fig. 1
Fig. 2
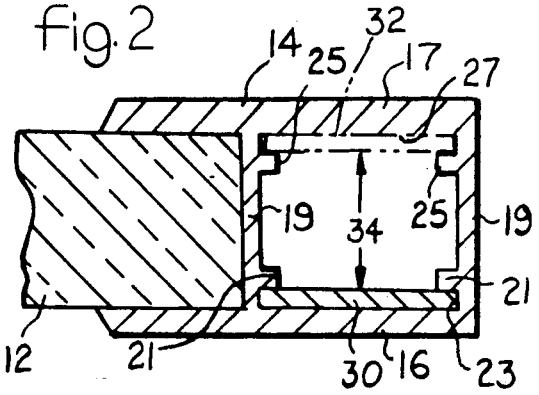
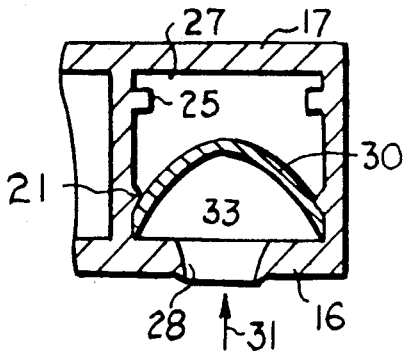
Fig. 3
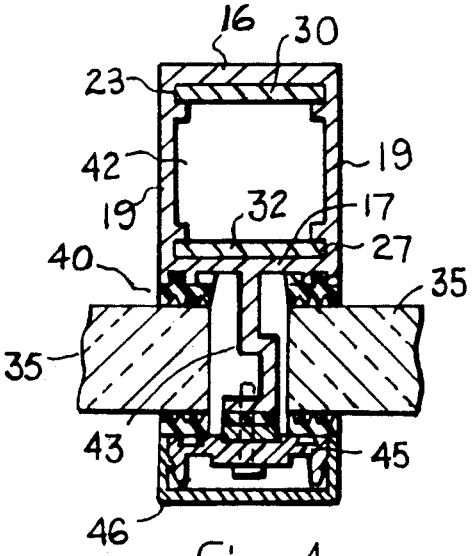
Fig. 4
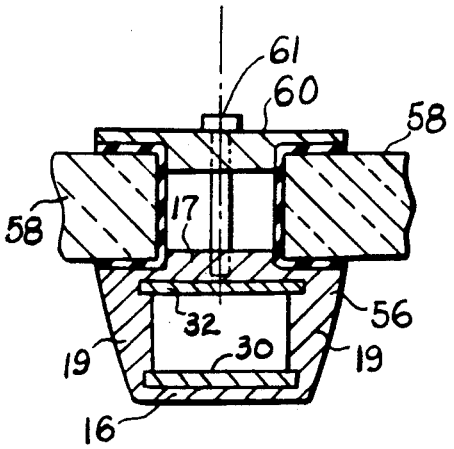
Fig. 6
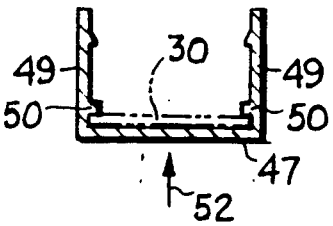
Fig. 5

BULLET RESISTANT FRAME STRUCTURE

BACKGROUND AND SUMMARY OF THE INVENTION

This invention relates to architectural rail systems used to support bullet-resistant panels within buildings, e.g. door panels, window panels, storefront panels, or security barrier panels (in banks, drug stores, cashiers, windows, etc.). The panels can be transparent acrylic panels having the ability to resist penetration by small arms fire. The associated rail systems can be hollow aluminum extrusions for securing the panels to the individual rails. In the case of barrier walls and store fronts, the rails will serve as supporting devices for the panels.

Acrylic panels and other laminated transparent sheet assemblies have the ability to resist penetration or destruction by small arms fire. However, the associated aluminum support rails do not have similar abilities. The present invention contemplates the use of internal ballistic steel panels (strips) within the aluminum rails to reinforce the rails against the passage of ballistic projectiles transversely through the rails.

In carrying out the invention, conventional aluminum rails are modified by the addition of longitudinal track-forming ribs within the hollow interior of the rails. Flat elongated strips of ballistic material (e.g. steel) are slidably moved into and along the tracks to occupy fixed positions within the rails. Each ballistic strip extends the full length of the associated rail.

Each aluminum rail in the system is preferably formed with at least two longitudinal internal tracks. A separate ballistic panel (strip) is inserted into each track. In some cases, it may be necessary or desirable (for cost reasons) to use only one of the tracks, with some reduction in the ballistic protection. One of the tracks is located at or near the front longitudinal wall of the rail. The other track is located at or near the rear wall of the rail. With such an arrangement, the two ballistic panels (strips) are spaced along the path of the projectile. When the rail is subjected to ballistic attack, the frontmost ballistic panel bends or deflects under the force of the projectile, thereby absorbing most or all of the kinetic energy possessed by the projectile. The spacing of the ballistic panels forms an expansion zone that accommodates the rearwardly bulged section of the frontmost panel. The second (rear) ballistic panel acts as a backup interception device to capture any low energy fragments or particles that might be shed from the projectile or the deflected portion of the front ballistic panel.

The "spaced panel" system of this invention avoids the punchthrough action that can sometimes occur when ballistic panels are placed flat against one another without any spacing along the direction of projectile motion. In such cases, the front panel is reinforced by the rear panel so that the front panel cannot deflect to effectively absorb projectile energy. The projectile tends to punch through the panels so that fragments are sprayed into the zone behind the protective panels.

The present invention is perceived as a relatively low cost method for providing aluminum architectural rails with effective ballistic protection features. Multiple tracks are integrally formed in the rails, such that ballistic panels can be selectively inserted into one or all of the tracks to provide different levels of protection.

THE DRAWINGS

FIG. 1 is an elevational view of a door having a rail system of the present invention incorporated therein.

FIG. 2 is an enlarged fragmentary sectional view taken on line 2—2 of FIG. 1.

FIG. 3 is a view taken in the same direction as FIG. 2, but showing a ballistic panel in a deflected (deformed) condition after being impacted by a ballistic projectile (rifle or small arms fire).

FIG. 4 is a fragmentary sectional view through a security barrier embodying the invention.

FIG. 5 is a sectional view through a rail component usable in the FIG. 4 security barrier.

FIG. 6 is a fragmentary sectional view taken through another rail system embodying the invention.

DESCRIPTION OF A PREFERRED EMBODIMENT OF THE INVENTION

FIG. 1 illustrates a door 10 that includes a central rectangular panel 12 and four framing rails 14 encircling edge areas of the panel. Panel 12 can be formed of a transparent acrylic material, with a panel thickness of at least one and one fourth inch, which is sufficient to provide a level of protection against penetration by rifle bullets or smaller caliber pistol bullets. FIG. 2 shows the cross-sectional configuration of a representative one of rails 14. The rail is an aluminum extrusion.

The rail shown in FIG. 2 has a front wall 16, rear wall 17 and two side walls 19. Extending inwardly from side walls 19 are two opposed ribs 21 that cooperate with front wall 16 to form a track 23. Two additional ribs 25 extend from walls 19 in near adjacency to rear wall 17 to form a second track 27. Each track extends the full length of the hollow rail to slidably accommodate and support a ballistic panel. One such panel 30 is shown in track 23. Another such panel is designated by the dashed lines 32 in track 27. Each ballistic panel extends the full length of rail 14 to protect against the passage of a ballistic projectile transversely through the rail. One such projectile trajectory (path) is designated by arrow 31 in FIG. 3.

FIG. 3 shows the condition of panel 30 after impacted by a ballistic projectile (not shown). The panel remains flat except for the localized bulged condition. An entrance hole 28 is formed in the relatively soft front wall 16 of the aluminum rail. The impact causes ballistic panel 30 to be deflected (deformed) into a rearwardly-bulged condition extending into the space between tracks 23 and 27. In the process of being deformed, panel 30 absorbs some or all of the kinetic energy possessed by the projectile. Associated ribs 21 are deformed so as to also absorb some of the projectile energy.

As seen in FIG. 3, panel 30 remains imperforate, such that the entire projectile (or projectile fragments) is contained within zone 33 on the front side of the panel. In some situations, panel 30 would be penetrated so that the projectile (or fragments) pass through the panel toward rear wall 17. If there is a second ballistic panel 32 mounted in rear track 27, that panel will restrain the projectile against passage through wall 17. The use of a second ballistic panel 32 is an option that provides an enhanced level of ballistic protection.

The two ballistic panels are not necessarily formed of the same material. Front panel 30 is preferably formed of a fracture-resistant material that is tough and deformable, such that the panel can deform (bulge rearwardly)

to absorb projectile energy. The front face of panel 30 should be relatively hard to deform and flatten the projectile nose, thereby better distributing the forces into the panel. Case-hardened steel, as used for armor plate, is a suitable material for panel 30.

The rear ballistic panel can be the same material as panel 30 or a different material such as a ceramic or a composite, e.g. Kevlar. The rear panel does have to deform to perform its function. For cost reasons, steel may be used for both ballistic panels. The front-to-rear spacing of the two panels, designated by numeral 34 in FIG. 2, is at least one inch in order to provide sufficient space for a complete bulging of panel 30 (i.e. a complete or near-complete absorption of the projectile energy). Also, the ribs 21 should preferably project only a limited distance from walls 19, such that panel 30 is supported along its side edges but not along its longitudinal midplane. The aim is to support the panel in such fashion that it can deform appreciably in response to the projectile impact force.

The thickness and material used for panel 30 will have some effect on its ballistic performance. A steel panel will have a preferred thickness of only about 0.15 inch. A significantly thicker panel would tend to be more rigid (less deformable), with increased potential for an undesired punch-through of the projectile. A thicker steel panel would also add weight and cost to the door structure.

FIG. 4 showns another form of the invention, wherein two bullet-resistance acrylic, transparent panels 35 have their edge areas supported in (by) a hollow rail mechanism 40. Typically, the acrylic panels would form parts of a transparent vertical barrier wall in a bank for separating the customer area from the teller area. FIG. 4 is a sectional view taken in a horizontal plane and looking downwardly through the rail mechanism cross section.

Rail mechanism 40 comprises a first hollow rail 42 having an integral extension 43 extending between the edges of panels 35 to abut against an elongated clamp member 45. Screws extend through member 45 into extension 43 to enable rail 42 and member 45 to cooperatively clamp edge areas of panels 35. Member 42 serves a support function for panels 35. An ornamental channel cross-sectioned cap 46 has a snap fit on member 45.

Rail mechanism 40 provides a bullet-resistant framing system for transparent panels 35. Rail 42 has a front wall 16, rear wall 17, and side walls 19. Ribs project from walls 19 to form tracks 23 and 27 for slidable support of ballistic panels 30 and 32. The rail system is resistant to projectiles fired in directions generally transverse to the general plane of panels 35. Operationally, the FIG. 4 rail mechanism performs in the same fashion as the rail mechanism shown in FIGS. 2 and 3.

FIG. 5 shows a modification of the ornamental cap member (46 in FIG. 4), whereby a ballistic panel can be incorporated therein. The cap member shown in FIG. 5 comprises a front wall 47 and two side walls 49. Ribs 50 extend from walls 49 to form a track for slidably accommodating a ballistic panel 30. Side walls 49 have relatively long transverse dimensions (at least about one and one half inch), such that when the cap member is installed onto clamp member 45 (FIG. 4), a space is formed between panel 30 and member 45. This space will accommodate the deformation of panel 30 when a projectile, is fired in the arrow 52 direction.

FIG. 6 shows another rail construction that might be used in a store front installation, wherein ballistic protection is desirable (e.g. jewelry stores). A vertically-extending hollow rail 56 engages with edge areas of two transparent acrylic panels 58. A clamping bar 60 engages edge areas of the panels by means of a series of screws 61 (only 1 shown) extending through the bar into rear wall 17 of rail 56.

Rail 56 has a front wall 16, rear wall 17 and side walls 19. Ribs project from walls 19 to form tracks for slidably guiding and supporting ballistic panels 30 and 32. The ribs in this case extend along essentially the entire cross-sectional extent of each wall 19 (as seen in FIG. 6) except for the grooves that form the tracks. The tracks (grooves) are spaced at least about one inch to provide for expansion space for accommodating panel deformation. The construction of FIG. 6 operates ballistically in essentially the same fashion as the construction of FIGS. 2 and 3.

It will be seen from the drawings and the above comments that the invention can be practiced in various structural forms. However, in each case the rail framing member should be formed with at least two internal tracks spaced to slidably accommodate one or two ballistic panels (depending on the level of protection desired). The ballistic panels extend the full length of the associated rail. Also, the ballistic panels are spaced at least about one inch to accommodate rearward bulging of the frontmost ballistic panel. The frontmost ballistic panel is supported along its side edges, with the opposed support ribs being spaced to leave the central portion of the panel unsupported. Preferably the frontmost ballistic panel 30 is positioned flat against the associated front wall of the hollow rail so as to minimize the formation of fragments.

I claim:

1. An architectural framing system resistant to ballistic penetration, comprising:

a hollow rail means of a first material, said rail means having a longitudinal front wall constituting a potential ballistic target, a longitudinal rear wall spaced an appreciable distance behind the front wall, and two longitudinal side walls interconnecting said front and rear walls;

parallel internal rib means extending longitudinally along inner surfaces of said two side walls to form a first track between the rib means and the front wall; and a ballistic panel of a second material insertable into the first track adjacent and parallel to said front wall.

2. The framing system of claim 1, and further comprising a second ballistic panel insertable into the second track adjacent said rear wall.

3. The framing system of claim 2, wherein said hollow rail means is formed of aluminum, and each ballistic panel is formed of steel.

4. The framing system of claim 1, wherein said hollow rail means is a one piece aluminum extrusion, said internal rib means being integral with said rail side walls.

5. The framing system of claim 1, wherein said rib means comprises first and second ribs extending from the side walls toward each other in near proximity to the rail means front wall; said first and second ribs having facing edges thereof spaced a considerable distance apart to provide an expansion zone for the ballistic panel.

6. The framing system of claim 5, and further comprising a second ballistic panel insertable into the second track adjacent the rear wall; said tracks being spaced so that the rear face of the first ballistic panel is at least one inch from the front face of the second ballistic panel.

7. The framing system of claim 1, wherein said rib means comprises a first set of opposed ribs extending from the rail means side walls in close parallelism with the rail means front wall to form the first track, and a second set of opposed ribs extending from the rail means side walls in close parallelism with the rail means rear wall to form the second track; said rail means being a one piece aluminum extrusion, with both sets of ribs being integral components of said extrusion.

8. The framing system of claim 7, and further comprising a second ballistic panel insertable into said second track adjacent said rear wall; the first ballistic panel having a thickness such that the force of the ballistic projectile thereon causes it to bulge rearwardly into the space between the two panels, thereby enabling said first panel to absorb a major portion of the kinetic energy possessed by the projectile.

9. The framing system of claim 8, wherein said first ballistic panel is a steel panel having a transverse thickness of about 0.15 inch.

10. The framing system as defined in claim 1, in which the ballistic panel is deformable in the space between the front wall and the rear wall to at least partially absorb the kinetic energy of a projectile penetrating said front wall and contacting the ballistic panel.

11. A framing system as defined in claim 1, in which the rib means are deformable so as to at least partially absorb the kinetic energy of a projectile penetrating said front wall and contacting the ballistic panel.

12. A framing system as defined in claim 1, in which the ballistic panel and the rib means are deformable to cooperate in absorbing the kinetic energy of a projectile penetrating said front wall.

13. A framing system as defined in claim 1, in which the rib means and the rear wall form a second track therebetween for a second ballistic panel.

14. A framing system as defined in claim 13 including a second ballistic panel, disposed in the second track, parallel to the first ballistic panel.

15. The framing system of claim 13, wherein said tracks are spaced at least about one inch apart.

16. A framing system as defined in claim 1, in which the ballistic panel has a width extending substantially the full internal distance between the two side walls.

17. A framing system as defined in claim 1, in which the hollow rail means comprises an aluminum extrusion, and the ballistic panel comprises a steel plate.

18. An architectural framing system resistant to ballistic penetration, comprising:

a hollow rail means having a longitudinal front wall constituting a potential ballistic target, a longitudinal rear wall spaced an appreciable distance behind the front wall, and two longitudinal side walls interconnecting said front and rear walls;

spaced first and second parallel internal ribs extending longitudinally along inner surfaces of said two side walls to form a first track between said first and second ribs and the front wall; and a ballistic panel insertable into the first track adjacent and parallel to said front wall, the ballistic panel being deformable so as to bulge between the first and second ribs, toward the rear wall to at least partially absorb the kinetic energy of a projectile penetrating the front wall and contacting the ballistic panel.

* * * * *